US005418116A

United States Patent [19]

Gottschalk et al.

[11] Patent Number: 5,418,116

[45] Date of Patent: May 23, 1995

[54] IMAGE TONING OF BLACK-AND-WHITE IMAGES FORMED UTILIZING COLOR DYE FORMING COUPLERS

[75] Inventors: Gary R. Gottschalk; Joseph I. Varga, both of Rochester, N.Y.

[73] Assignee: Eastman Kodak Company, Rochester, N.Y.

[21] Appl. No.: 163,222

[22] Filed: Dec. 7, 1993

[51] Int. Cl.[6] ..... G03C 5/40; G03C 5/46

[52] U.S. Cl. ..... 430/370; 430/357; 430/359; 430/367; 430/368; 430/390; 430/402; 430/431; 430/462

[58] Field of Search ..... 430/357, 359, 367, 368, 430/370, 390, 391, 402, 430, 431, 462

[56] References Cited

U.S. PATENT DOCUMENTS

| | | | |
|---|---|---|---|
| 1,411,968 | 4/1922 | Kelley | 430/367 |
| 2,026,899 | 1/1936 | Kipphan | 430/359 |
| 2,467,359 | 4/1949 | Rubinstein | 430/359 |
| 2,515,121 | 7/1950 | Harsh et al. | 430/372 |
| 3,114,634 | 12/1963 | Brown et al. | 430/391 |
| 3,340,060 | 9/1967 | Meyer et al. | 430/392 |
| 4,125,402 | 11/1978 | Mollet | 430/390 |
| 4,370,402 | 1/1983 | Anderson | 430/357 |
| 4,990,430 | 2/1991 | Harder et al. | 430/431 |
| 5,262,285 | 11/1993 | Darmon et al. | 430/462 |
| 5,356,760 | 10/1994 | Okumura et al. | 430/402 |
| 5,362,616 | 11/1994 | Edwards et al. | 430/402 |
| 5,364,747 | 11/1994 | Edwards et al. | 430/402 |

FOREIGN PATENT DOCUMENTS

| | | | |
|---|---|---|---|
| 2202311 | 5/1974 | France | 430/370 |
| 879596 | 11/1961 | United Kingdom | 430/462 |
| 200428 | 11/1967 | U.S.S.R. | 430/370 |
| WO93/12465 | 6/1993 | WIPO . | |

*Primary Examiner*—Charles L. Bowers, Jr.
*Assistant Examiner*—J. Pasterczyk
*Attorney, Agent, or Firm*—Paul A. Leipold

[57] ABSTRACT

The invention relates to providing a method of toning a black-and-white image formed with color couplers comprising providing a developed image, applying a hue changing material to said print wherein the hue of at least dye in said print is changed.

3 Claims, No Drawings

IMAGE TONING OF BLACK-AND-WHITE IMAGES FORMED UTILIZING COLOR DYE FORMING COUPLERS

FIELD OF THE INVENTION

The invention relates to methods and materials for changing the tone of black-and-white images formed utilizing dye forming colored couplers.

BACKGROUND OF THE INVENTION

In the past, toners containing selenium and sulfide have been used on black-and-white prints to change the silver image hue to one that better conveys the mood or atmosphere of the subject. Proper disposal of these chemicals has always been required, even though environmental concerns were not as great as they are today. It is anticipated that further restriction will limit the use of these toners in the future. While still desirable, the traditional method of toning black-and-white prints will not be compatible with the new chromogenic black-and-white paper which uses color emulsions and couplers to create a neutral image with dyes rather than with silver as in traditional black-and-white photography. Because chromogenic black-and-white papers use dyes instead of silver, a dye bleach is necessary to change the hue.

Dye bleaching is used on EKTACHROME TM slides; however, color paper is not suitable for color adjustment by after treatment. Eastman Kodak publication E-70 states: "At this time there are no dye bleaches we can recommend for KODAK EKTACOLOR TM and EKTACHROME TM papers. The formulas previously published for use with earlier KODAK EKTACOLOR TM papers do not work satisfactorily with KODAK EKTACOLOR PLUS TM and Professional papers." The prior art has references to dye bleaching, such as Rubenstein U.S. Pat. No. 2,467,359 and Harder U.S. Pat. No. 4,990,430.

PROBLEM TO BE SOLVED BY THE INVENTION

There remains a need for a method of changing the tone or hue of black-and-white papers formed with color dyes formed from dye forming couplers. In the past, silver containing black-and-white images have been capable of being adjusted by various materials applied to the papers after image formation. There is a desire by photographers to also be able to do this with neutral black and white images formed utilizing color dyes.

SUMMARY OF THE INVENTION

It is an object of the present invention to allow toning of black-and-white images formed utilizing colored dye forming couplers.

Another object of the invention is to allow toning of black-and-white images produced by colored dyes in a manner similar to that utilized in toning of black-and-white images formed from silver.

These and other objects of the invention are generally accomplished by providing a method of toning a black-and-white image formed with color couplers comprising providing a developed print, applying a hue changing material to said print wherein the hue of at least one dye in said print is changed.

ADVANTAGEOUS EFFECT OF THE INVENTION

The invention provides a way in which dye bleaching can be used with a dye-based black-and-white paper to create substantially the same effect as was achieved with traditional toning of silver-based, black-and-white papers. The method has the advantage that it provides a method of toning similar to the effect of traditional toning of black-and-white, silver-based black-and-white paper. A further advantage is that the materials utilized in the toning process are generally not considered as environmentally hazardous materials.

DETAILED DESCRIPTION OF THE INVENTION

The invention involves the application of treatment materials to a neutral black-and-white print that is formed of the dyes from color couplers. The treatment of the invention, normally by dye bleaching, removes color from at least one of the yellow, magenta, and cyan dyes in the print to create a print that is not neutral. This is in contrast to the treatment of silver containing black-and-white images where a material such as selenium or sulfide is added to tone the print by reacting with the silver. For instance, in the invention prints may be bleached so as to become warmer and have the reddish brown look of early photographs. Such a look is popular for prints taken in tourist attractions, as it has the Old West look. Further, the treatment may be used to alter the look of the print to convey a mood, such as providing more blue to convey a winter or cold impression. It is surprising that bleaching of the dyes of the neutral prints formed with color dyes can be successfully treated in this manner, as color prints are not successfully treated this way to achieve any sort of desirable result.

The materials of the invention may be applied to the prints or negatives by any suitable means. Preferred methods are to immerse the print in a solution to give an overall effect, or local areas can be selectively swabbed with cotton or a brush, and one or more different dye bleaching solutions may be utilized at different portions of the print. Wetting a previously dry print to swell the emulsion and then surface-drying the print is necessary for the dye bleach to remain localized. A neutralizer solution may be added to stop the bleaching reaction at any desired point. In this way an artist can have the freedom to create a hand-painted look, much like what was often done in the early days of photography. These effects also are similar to what can be accomplished with conventional black-and-white papers containing silver and toners adapted for use with these papers. The chemicals utilized in the invention may be any materials that will provide the desired change in at least one of the dyes utilized in the print. Typical of such materials are acids such as hydrochloric acid and sulfuric acid. Other acids also may be utilized.

Further, it is possible that other materials such as bases, such as sodium hydroxide, and reactive compounds may also be suitable for the color adjustments of the invention. Preferred have been found to be the hydrochloric acid and sulfuric acid for creating the warmer reddish prints or the cooler bluish prints. The use of hydrochloric acid for formation of the warmer reddish look is preferred. The use of sulfuric acid for the formation of the cooler bluish prints is preferred. They are preferred because of their effectiveness and because they do not present significant environmental problems.

The invention may be practiced upon any black-and-white paper formed using colored couplers. The invention may also be practiced on black-and-white negatives formed using dyes formed from color couplers. These may be formed utilizing the silver halide grains that are pan or ortho sensitized and combined with magenta, cyan, and yellow couplers. However, the preferred papers are those formed with single sensitized silver halides such as disclosed in European Patent Application No. 93901465.0 filed Jul. 22, 1993. Photographic papers formed utilizing such techniques are available as Ektamax TM papers from Eastman Kodak.

The following examples utilize a black-and-white color paper formed generally as follows:

Formulation of the multilayer color paper:

Layer Structure 1: Multilayer Format

| Layer | Material | Coverage (mg/M$^2$) |
|---|---|---|
| Overcoat | gelatin | 1345.0 |
| | N | 21.5 |
| | D | 64.6 |
| | Alkanol-XC TM | 21.5 |
| UV Absorber | gelatin | 1398.8 |
| | Tinuvin 326 | 113.0 |
| | Tinuvin 328 | 640.2 |
| | N | 75.2 |
| Red Sensitive Layer | gelatin | 1990.6 |
| | Red sensitive silver halide | 351.7 |
| | Cyan coupler (A) | 478.3 |
| | Magenta coupler (B) | 252.2 |
| | Yellow coupler (C) | 562.5 |
| | Stabilizer (L) | 187.0 |
| | Coupler Solvent (D) | 562.0 |

-continued

Layer Structure 1: Multilayer Format

| Layer | Material | Coverage (mg/M$^2$) |
|---|---|---|
| | Aux. Solvent (E) | 530.9 |
| Green Sensitive Layer | gelatin | 2152.0 |
| | Green sensitive silver halide | 187.7 |
| | Cyan coupler (A) | 340.0 |
| | Magenta coupler (B) | 178.2 |
| | Yellow coupler (C) | 399.8 |
| | Stabilizer (L) | 132.9 |
| | Coupler Solvent (D) | 399.5 |
| | Aux. Solvent (E) | 377.4 |
| Blue Sensitive Layer | gelatin | 1506.4 |
| | Blue sensitive silver halide | 70.4 |
| | Cyan coupler (A) | 175.7 |
| | Magenta coupler (B) | 92.7 |
| | Yellow coupler (C) | 206.6 |
| | Stabilizer (L) | 68.7 |
| | Coupler Solvent (D) | 206.5 |
| | Aux. Solvent (E) | 195.0 |
| Resin Coated Support | | |

Layer Structure 1 shown above gives the structure and composition of the photographic element referred to in the Examples.

All three emulsions used in the multilayer element are silver chloro-bromide (99:1).

This coating was made on a conventional film forming machine. After coating it was exposed and processed. The colorimetric data was also obtained as described earlier. The results of the analysis show that at status A densities of 1.03 red, 1.04 green and 1.02 blue, the corresponding a* and b* values are 0.18 and 0.09 respectively. The related L* value is 38.5. In addition to the extremely low a* and b* values, the exposed patches appeared to be visually neutral.

A

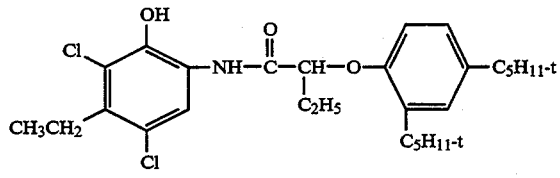

B

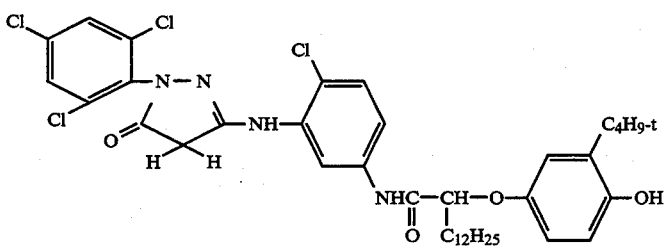

C

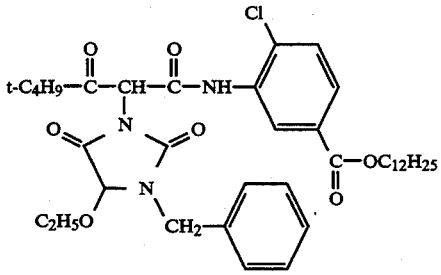

D

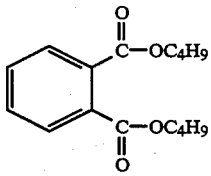

-continued

E

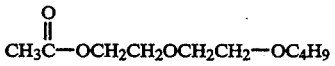

Tinuvin 326

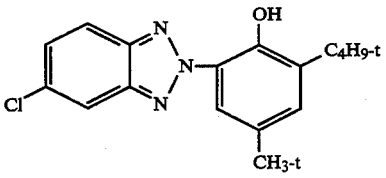

Dequest 2010

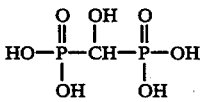

F

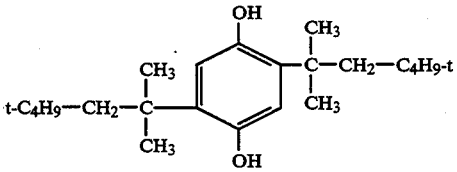

Tinuvin 328

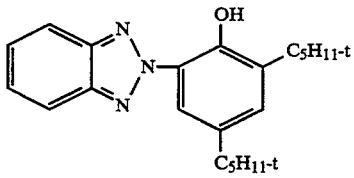

Alkanol-XC

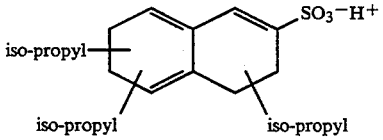

CD3

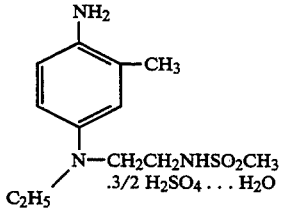

L

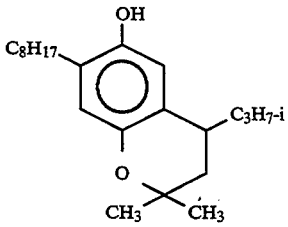

N

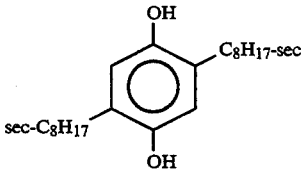

The development processes of the invention are the conventional ones utilized for color paper and are commonly known as the R-4 process.

The process is considered suitable for any black-and-white paper or negative film made with conventional color couplers. Color papers typically contain silver chloride emulsions. The process is suitable for use with negative film images formed from dyes that result from an imaging process utilizing color dye forming couplers to form a negative with silver bromide or bromoiodide. It is noted that the process of the invention is applied to a photograph as it appears after the silver has been removed and the image has been developed. Therefore, the type of silver halide utilized in the image formation is not a part of the invention. The examples below are intended to be exemplary and not exhaustive of the possibilities of the process of the invention.

EXAMPLES

Experimental procedures and data are presented which show the effects of solution concentration, time of immersion, and temperature of solution on the dye-bleaching process. Materials used are just examples of many chemicals that could be used.

The following solutions were tested:

| Cyan Dye Bleach I | Yellow Dye Bleach I | Magenta Dye Bleach I |
|---|---|---|
| water 800 ml. | water 700 ml. | water 500 ml. |
| HCl (36.5% dilute) 6 ml. | sulfuric acid 200 ml. (20% dilute) | HCl 415 ml. (36.5% dilute) |
| stannous chloride 9 grams | | |
| add water to make to 1 liter | add water to make 1 liter | add water to make 1 liter |

Samples from of the photographic paper above are given separation exposures of red, green, and blue light and processed. Each sample is treated in one (and only one) of the above solutions in a tray for two minutes with agitation at ambient temperature. An immediate reaction is apparent with the red and yellow dye bleaches. The samples turned pink for the duration of contact with the bleach solutions. This pink color disappears as soon as the samples are rinsed with water. All samples are washed for 20 minutes and air dried. After drying, it is evident that the red dye bleach produced the greatest hue change. The sample is no longer neutral, but very green. The cyan dye bleach produces a slightly warm brown tone. It is a pleasing "old West" look, similar to a sepia toned traditional black-and-white print. The yellow dye bleach produces a slightly warmer image. The samples are read on a densitometer, on step 10, resulting in the following data:

| SOLUTION | EXPOSURE | CYAN | MAGENTA | YELLOW |
|---|---|---|---|---|
| None | Red | .87 | .88 | .84 |
| (Check) | Green | .70 | .71 | .68 |
| | Blue | .35 | .35 | .32 |
| Cyan Dye | Red | .79 (−.08) | .81 (−.07) | .77 (−.07) |
| Bleach I | Green | .70 (0) | .72 (.01) | .70 (.02) |
| | Blue | .32 (−.03) | .32 (−.03) | .30 (−.02) |
| Yellow Dye | Red | .83 (−.04) | .85 (−.03) | .80 (−.04) |
| Bleach I | Green | .69 (−.01) | .70 (−.01) | .66 (−.02) |
| | Blue | .35 (0) | .34 (−.01) | .31 (−.01) |
| Magenta Dye | Red | .72 (−.15) | .66 (−.22) | .65 (−.19) |
| Bleach I | Green | .64 (−.06) | .59 (−.12) | .57 (−.11) |
| | Blue | .32 (−.03) | .29 (−.06) | .27 (−.05) |

Parentheses indicate deviation from untreated control sample.

EXAMPLE 2

The results of the testing looked promising enough that in this example they are continued with stronger solution concentrations and with prints, as well as step exposures. The following solutions were tested:

| Cyan Dye Bleach II | Yellow Dye Bleach II |
|---|---|
| water 700 ml. | water 200 ml. |
| HCl (36.5% dilute) 12 ml. | sulfuric acid (40% dilute) 800 ml. |
| stannous chloride 18 grams | |
| add water to make to 1 liter | |

Exposures were agitated by hand in 72 degree F (22° C.) solutions for 2 minutes. Densitometry of step separation exposures produced the following data:

| SOLUTION | EXPOSURE | CYAN | MAGENTA | YELLOW |
|---|---|---|---|---|
| None | Red | .82 | .82 | .80 |
| (Check) | Green | .89 | .87 | .86 |
| | Blue | .40 | .38 | .37 |
| Cyan Dye | Red | .51 (−.31) | .79 (−.03) | .78 (−.02) |
| Bleach II | Green | .50 (−.39) | .83 (−.04) | .83 (−.03) |
| | Blue | .27 (−.13) | .36 (−.02) | .36 (−.01) |
| Yellow Dye | Red | .77 (−.05) | .65 (−.17) | .65 (−.15) |
| Bleach II | Green | .83 (−.06) | .68 (−.19) | .70 (−16) |
| | Blue | .38 (−.02) | .30 (−.08) | .31 (−.06) |

Parentheses indicate deviation from untreated control sample.
The stronger solution concentrations had a great impact on increasing the effectiveness of the bleaches, as is evident when this data is compared to the previous data.

EXAMPLE 3

Length of time of immersion in the bleach solutions and temperature of the solutions were studied, using the more concentrated formulas of the previous test of Example 2 and the same paper.

Processed step exposures were treated in solution for 15, 30, 60, or 120 seconds at 72 or 100 degrees F (22° or 38° C.).

| SOLUTION | EXPOSURE | CYAN | MAGENTA | YELLOW |
|---|---|---|---|---|
| Cyan Dye | Red | .71 | .84 | .81 |
| Bleach | Green | .72 | .86 | .86 |
| Comparison | Blue | .34 | .38 | .38 |
| 120 sec./72° F. (22° C.) | | | | |
| Cyan Dye | Red | .75 (.04) | .85 (.01) | .82 (.01) |

-continued

| SOLUTION | EXPOSURE | CYAN | MAGENTA | YELLOW |
|---|---|---|---|---|
| Bleach II | Green | .75 (.03) | .86 (.00) | .85 (−.01) |
| 60 sec./72° F. (22° C.) | Blue | .36 (.02) | .38 (.00) | .38 (.00) |
| Cyan Dye | Red | .74 (.03) | .83 (−.01) | .81 (.00) |
| Bleach II | Green | .76 (.04) | .86 (.00) | .85 (−.01) |
| 30 sec./72° F. (22° C.) | Blue | .36 (.02) | .39 (.01) | .38 (.00) |
| Cyan Dye | Red | .74 (.03) | .83 (−.01) | .80 (−.01) |
| Bleach II | Green | .76 (.04) | .86 (.00) | .85 (−.01) |
| 15 sec./72° F. (22° C.) | Blue | .36 (.02) | .38 (.00) | .38 (.00) |
| Cyan Dye | Red | .64 (−.07) | .81 (−.03) | .79 (−.02) |
| Bleach II | Green | .63 (−.09) | .84 (−.02) | .84 (−.02) |
| 120 sec./100° F. (38° C.) | Blue | .32 (−.02) | .37 (−.01) | .37 (−.01) |

Parentheses indicate deviation from 120 second/72 degrees F.
Cyan Dye Bleach treatment is effected very little by time of immersion from 15–60 seconds. At 120 seconds there is a greater reaction to the bleach. Temperature of solution has a very noticeable effect, with 100 degrees F. (38° C.) producing a much more robust treatment with more brown tone as shown by the 100 degrees F. (38° C.) sample above.

| SOLUTION | EXPOSURE | CYAN | MAGENTA | YELLOW |
|---|---|---|---|---|
| Yellow Dye | Red | .80 | .71 | .68 |
| Bleach | Green | .86 | .74 | .72 |
| Comparison | Blue | .41 | .34 | .34 |
| 120 sec./72° F. (22° C.) | | | | |
| Yellow Dye | Red | .82 (.02) | .77 (.06) | .75 (.07) |
| Bleach II | Green | .88 (.02) | .81 (.07) | .80 (.08) |
| 60 sec./72° F. (22° C.) | Blue | .41 (.02) | .37 (.03) | .37 (.03) |
| Yellow Dye | Red | .81 (.01) | .81 (.10) | .78 (.10) |
| Bleach II | Green | .89 (.03) | .85 (.11) | .84 (.12) |
| 30 sec./72° F. (22° C.) | Blue | .41 (.00) | .39 (.05) | .38 (.04) |
| Yellow Dye | Red | .81 (.01) | .82 (.11) | .79 (.11) |
| Bleach II | Green | .89 (.03) | .87 (.13) | .85 (.13) |
| 15 sec./72° F. (22° C.) | Blue | .41 (.00) | .39 (.05) | .37 (.03) |
| Yellow Dye | Red | .77 (−.03) | .55 (−.16) | .54 (−.14) |
| Bleach II | Green | .84 (−.02) | .58 (−.16) | .57 (−.15) |
| 120 sec./100° F. (38° C.) | Blue | .39 (−.02 | .28 (−.06) | .27 (−.07) |

Parentheses indicate deviation from 120 second/72 degrees F.
Yellow Dye Bleach treatment is effected by time of immersion to a greater degree than Cyan Dye Bleach treatment. Each incremental increase in treatment time produced visibly more blue-green hue to the samples, as supported by the above sensitometry.

This technique as shown in the above examples introduces the first method of hue manipulation for EKTAMAX prints found from blends of color couplers, and will provide an environmentally safer alternative to toning traditional black-and-white prints. To accomplish this it is only necessary to have dye present, as silver is not required. In conjunction with EKTAMAX TM papers, our invention provides a method for toning chromogenic black-and-white-based prints, that heretofore has not existed. Our method provides an environmentally acceptable method of black-and-white print toning.

The invention has been described in detail with particular reference to preferred embodiments thereof, but it will be understood that variations and modifications can be effected within the spirit and scope of the invention.

We claim:

1. A method of toning a neutral black-and-white image formed from a silver halide photographic material comprising at least one layer comprising a single sensitized silver halide combined with cyan, magenta, and yellow dye forming color couplers, comprising providing a developed neutral black-and-white image formed from dyes formed from color couplers, and applying a hue-changing composition comprising sulfuric acid to said image wherein the hue of at least one dye in said image is changed and said image changes from a neutral to a sepia tone.

2. The method of claim 1 wherein said hue-changing composition further comprises stannous chloride.

3. A method of toning a neutral black-and-white image formed from a silver halide photographic material comprising at least one layer comprising a single sensitized silver halide combined with cyan, magenta, and yellow dye forming color couplers, comprising providing a developed neutral black-and-white image formed from dyes formed from color couplers, and applying a hue-changing composition comprising sulfuric acid to said image wherein the hue of at least one dye in said image is changed and said image changes from said neutral to a bluish hue.

* * * * *